US009539496B1

(12) United States Patent
Shoemaker, Jr.

(10) Patent No.: US 9,539,496 B1
(45) Date of Patent: Jan. 10, 2017

(54) CRANE GAME WITH MODIFIED PULLEY SYSTEM

(71) Applicant: Stephen P. Shoemaker, Jr., Redondo Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 15/239,767

(22) Filed: Aug. 17, 2016

(51) Int. Cl.

| | |
|---|---|
| ***A63F 9/30*** | (2006.01) |
| ***A63F 9/24*** | (2006.01) |
| ***A63F 9/00*** | (2006.01) |
| ***G07F 17/32*** | (2006.01) |

(52) U.S. Cl.
CPC ..... *A63F 9/30* (2013.01); *A63F 9/0079* (2013.01); *A63F 9/24* (2013.01); *G07F 17/3246* (2013.01); *G07F 17/3248* (2013.01); *A63F 2009/0081* (2013.01)

(58) Field of Classification Search
CPC ..... A63F 9/30; A63F 9/0079; A63F 9/24; A63F 2009/0081; G07F 17/3246; G07F 17/3248
See application file for complete search history.

(56) References Cited

U.S. PATENT DOCUMENTS

| | | | | |
|---|---|---|---|---|
| 5,967,892 | A * | 10/1999 | Shoemaker, Jr. | A63F 9/24 273/448 |
| 6,234,487 | B1 * | 5/2001 | Shoemaker, Jr. | A63F 9/30 273/447 |
| 6,770,001 | B1 * | 8/2004 | Shoemaker, Jr. | A63F 9/30 273/448 |
| 7,857,318 | B1 * | 12/2010 | Shoemaker, Jr. | A63F 9/30 273/447 |
| 8,016,292 | B1 * | 9/2011 | Yang | A63F 9/30 273/447 |
| 8,070,167 | B1 * | 12/2011 | Shoemaker, Jr. | A63F 9/30 273/447 |
| 2003/0151202 | A1 * | 8/2003 | Fisher | A63F 9/30 273/447 |
| 2007/0114725 | A1 * | 5/2007 | Peck | A63F 9/30 273/447 |
| 2007/0126185 | A1 * | 6/2007 | Fukuzawa | A63F 9/30 273/447 |
| 2008/0090629 | A1 * | 4/2008 | Matsuda | A63F 9/30 463/7 |

* cited by examiner

*Primary Examiner* — Raleigh W Chiu
(74) *Attorney, Agent, or Firm* — Fulwider Patton LLP

(57) ABSTRACT

An arcade game is disclosed having a modified three dimensional control of an acquisition device using three motors, pulleys, and belts that maneuver the acquisition device in three directions. Each belt is located in a pair of pulley wheels that have a "grooved section that allows the belt to slip when the motor reaches an end of its cycle, eliminating the need for switches and clutches.

6 Claims, 4 Drawing Sheets

CRANE GAME WITH MODIFIED PULLEY SYSTEM

BACKGROUND

"Crane" type arcade games have been around for many years. A crane is supported in a housing and manipulated by a player to center the crane over a prize. The player then actuates a motor that lowers the crane and attempts to pick up the prize using the crane. If the player has successfully positioned the crane, the claw, vacuum, or other pick-up mechanism may acquire the prize and bring it to a retrieval bin where the player can collect the prize. The prior art is rife with such games, although advancements are continuously made due to the popularity of such games.

One aspect of the game that has not received much attention is the manner in which the crane is maneuvered over the playing field prior to lowering the pick-up device. In the past, a gear or worm drive system moved the crane on an X, Y and Z axes. Changes in the types of targets from plush animals and heavier prizes to tickets, cards, and other lighter targets reduced the need for a powerful gear or worm drive. Tickets, gift cards, post cards, or objects that are very light weight are easily moved and do not require a heavy duty drive system. In the vacuum crane games, prizes can be stacked in central locations so the crane rarely reaches a stall position. An example of a two pulley crane game is described in U.S. Pat. No. 6,234,487 entitled Crane Game Claw Gauge, the contents of which are fully incorporated herein by reference.

The aforementioned drive mechanism used a gear or a worm drive, and switches are used to stop or control the direction of the movement of the pick-up mechanism. The pick-up mechanism goes left/right (X), forward/back (Y), and up/down (Z) using motors, gears, and switches. At the end of each path there is an electrical or mechanical switch that causes the motors to stop or change directions. Since there are three motors, that results in at least six switches (one for each direction of travel), with two to three wires per switch. The electronic control system for the many wires, plugs, and connectors, all subject to wear and malfunction, results in high maintenance of the games. This mechanism is unduly complicated and a bad switch, or mal-adjusted one, can burn out a motor, as can defective or damaged wires, plugs, and connectors that results in a non-working game and loss of revenue to the operator.

The alternative is to use a clutch mechanism in place of the switches. The clutches are more reliable, but they are more complicated to build, incorporate more moving parts, and are more expensive than the switches. This added cost of the game is also a limiting factor on how small the game can be made, since the clutches are much larger and take up more space than the switches. An alternative to this system would benefit the art.

SUMMARY OF THE INVENTION

The present invention is a crane-type arcade game that uses an new belt drive system to move the pick-up device around the playing field. The term "pick-up device" can be a mechanical, claw, a vacuum, device, or any other mechanism to lift or capture a prize in an arcade game. The present invention utilizes a belt drive in place of switches or oversized and obtrusive clutches. The belt goes around a pulley and moves the pick-up device. The combination can be a "V" pulley and a round belt, a "V" pulley and a "V" belt, a flat pulley and a flat belt, or any variation that has enough drive friction to move the mechanism yet allow for slipping when the mechanism is stalled. The belt drive allows the carriage that carries the pick-up device to move forward and back, and left and right, and further controls the vertical movement of the pick-up device. When the carriage reaches the end of its track, the belt slips on the pulley to function in place of a clutch or switch. This has the advantage of fewer switches, plugs, and connectors, less wires and no expensive or bulky clutches. Aside from being simpler, the belt drive system costs about fifty percent less to make, resulting in a less expensive and more reliable game. Since the belt is flexible and/or elastic, should the belt loosen, it can be made tighter by simply pulling one end of the belt to shorten it.

These and other advantages of the present invention can best be understood with reference to the detailed description of the invention below along with the following figures.

DETAILED DESCRIPTION OF THE PREFERRED EMBODIMENTS

Figure 1:
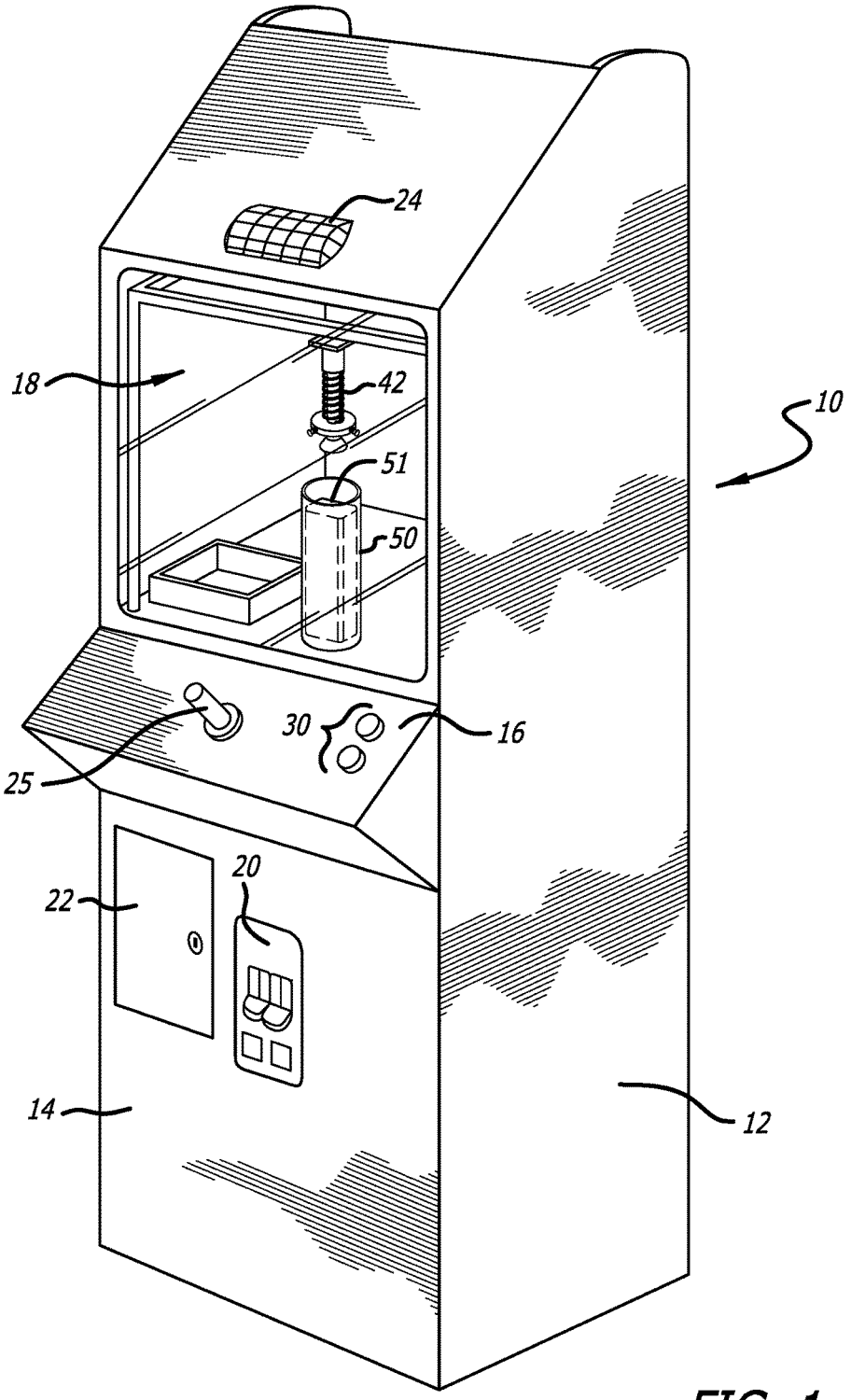
FIG. 1 is an elevated, perspective view of an exemplary crane game.

FIG. 1 illustrates an arcade crane game, such as that described in U.S. patent application Ser. No. 14/838,980 entitled "Vacuum Crane Game," by the present inventor, the contents of which are fully incorporated herein by reference. The game apparatus 10 includes a housing 12, front panel 14, and a playing area 18. Housing 12 provides a support for the other components of the game apparatus. Housings can take a wide variety of forms; for example, as shown in FIG. 1, housing 12 may be of the stand-up variety in which a player stands in front of the game or sits on a stool when playing the game. In other embodiments, other types of housings may be provided. For example, a counter-top housing, including approximately the upper half of housing 12 shown in FIG. 1, can be used when the game apparatus 10 is desired to be placed on a table, counter top or other similar surface.

Front panel 14 includes a player control panel 16 that includes player controls 30. Front panel 14 includes a coin deposit slot 20, and a speaker 24 may also be provided on the housing 12. Coin deposit slot 20 may be more generally thought of as a payment area, where the game can accept payment in the form of currency, coins, game tokens, bills, tickets, and the like. In some embodiments, other types of monetary input may also be provided using a magnetic card reader to read a card with a magnetic strip that holds game credit information, or a bank card such as a credit card, debit card, etc. A token deposited in coin deposit slot 20 (or other payment method) starts a game. Dispenser compartment 22 is used to provide access to the retrieval bin in the event of a successful attempt by the player.

Speaker(s) 24 can emit sounds based on game actions and other game states and is controlled by a game control system as described subsequently. The front panel 14 can also include other features if appropriate. Player control panel 16 allows a player to manipulate events in the game, and includes player controls 30 such as an actuation device such as a push button to initiate the movement of the extraction device. Alternatively, the position of the starting point for the extraction device in the two dimensional X-Y vertical plane can be controlled by a joystick 25, roller ball, touchscreen, or other input device. Game action occurs in playing area 18, where a vacuum extraction device is moved in the playing area 18 using the joystick 25 or other controller device. The extraction device 42 is moved horizontally by the player using the player controls and joystick 25 to a position over the playing field where the prizes/gift cards are located, and the skill involved is the precision with which the player can accurately control the placement or movement of the extraction device 42.

At the bottom of the playing area 18 is a cylindrical column or silo 50, but the game can include multiple such silos. Each silo 50 includes an enclosure formed by a continuous wall that defines a target area, and houses a stack of gift cards 51. The target area formed by the circular silo wall is dimensioned so as to be slightly larger than the largest dimension (e.g., a diameter) of the extraction device 42. Thus, only by precisely hovering the extraction device 42 over the silo's target area can the player successfully lower the extraction device into the silo 50 to collect a gift card 51. Another version referenced in U.S. Pat. No. 8,070,167 to the present inventor, the contents of which are incorporated herein by reference, is a simple switch at the bottom of the silo that designates a winning attempt and signals the result.

Figure 2:
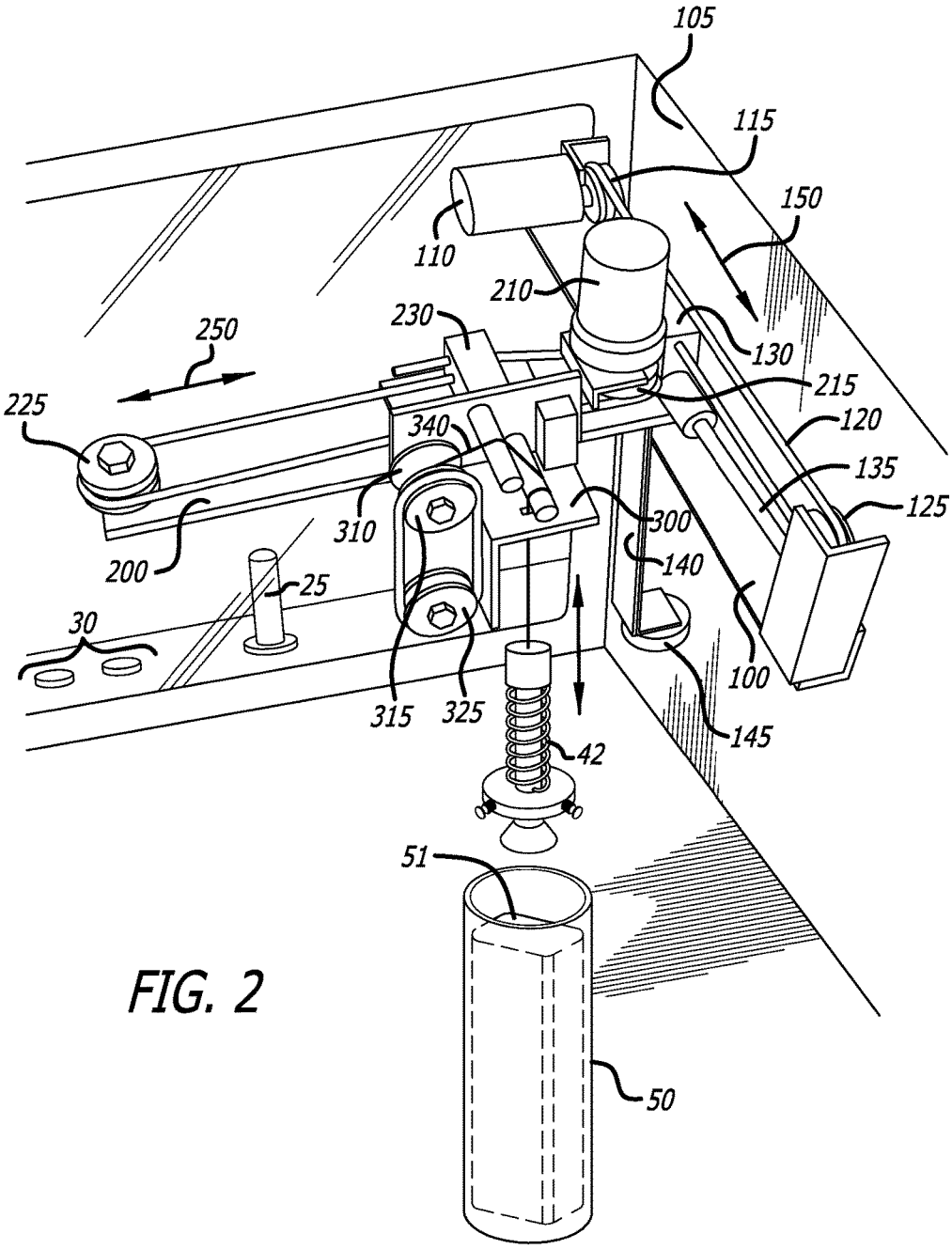
FIG. 2 is an enlarged, elevated perspective view of the belt drive system.

FIG. 2 illustrates the slipping belt drive system that moves the extraction device 42 over the playing field. The extraction device 42 must be moved in three directions to permit the extraction device to be located over a target and then lowered to acquire the target. The belt drive system uses three motors and three belt drive systems to control the movement of the extraction device 42, where the player controls are electrically connected to the motors that govern the movements of the game. The electrical wires that connect the motors to the circuit board are omitted for brevity to better emphasize the components of the invention.

L-shaped platform 100 is mounted to the housing 14 along a first playing field side wall 105 onto which electric motor 110 is mounted. Motor 110 is has an output shaft that includes a pulley wheel 115 onto which a belt 120 is secured. The belt extends across the platform 100 to a second pulley wheel 125 and then to a block 130. The other end of the belt 120 is also connected to the block 130 at the opposite side. The block 130 is mounted on a rod 135 that spans the platform 100 so that the block can move from one end of the playing field to the other along the rod 135. As the motor's shaft rotates, the belt 120 moves the block 130 from one side of the platform 100 to the other and back. When the block 130 gets to the end of the platform, the belt slips in the groove of the pulley similar to a clutch, but without the space needed for the clutch or the complication of a clutch.

The platform 100 includes a stabilizer bar 140 that includes a round follower 145 in contact with the wall 105 to balance the block and its associated components from tipping over or unduly torqueing the platform 100. A signal from the player controls is sent to a controller (not shown) that relays a signal to the motor 110 to rotate in a first or second direction, which in turn drives the belt in the forward or backward direction. The movement of the belt 120 displaces the block 130 along the rod 135 over the playing field's front to back direction as shown in arrow 150. Thus, a first direction of the acquisition device 42 is controlled by this motor subsystem.

Mounted to the block 130 is a second platform 200 extending perpendicular to platform 100. Platform 200 carries a second electric motor 210 having a drive shaft that is connected to a pulley wheel 215, where a second belt 220 is located. The second belt 220 extends across the second platform 200 to a pulley 225 and then to a block 230. Rotation of the motor 210 causes the belt 220 to rotate about the pulley and cause the block 230 to move across the platform in the right to left and back to right direction, as shown in arrow 250. The block 230 may be supported on a roller (not shown) to allow the block 230 to move easily across the platform 200. A signal from the player controls is sent to the controller that relays a signal to the motor 210 to rotate in a first or second direction, which in turn drives the belt 220 in the left and right directions. The movement of the belt 220 displaces the block 230 along the platform 200 across the playing field one side to the other as shown in arrow 250. Thus, a second direction of the acquisition device 42 is controlled by this second motor subsystem.

Figure 3:
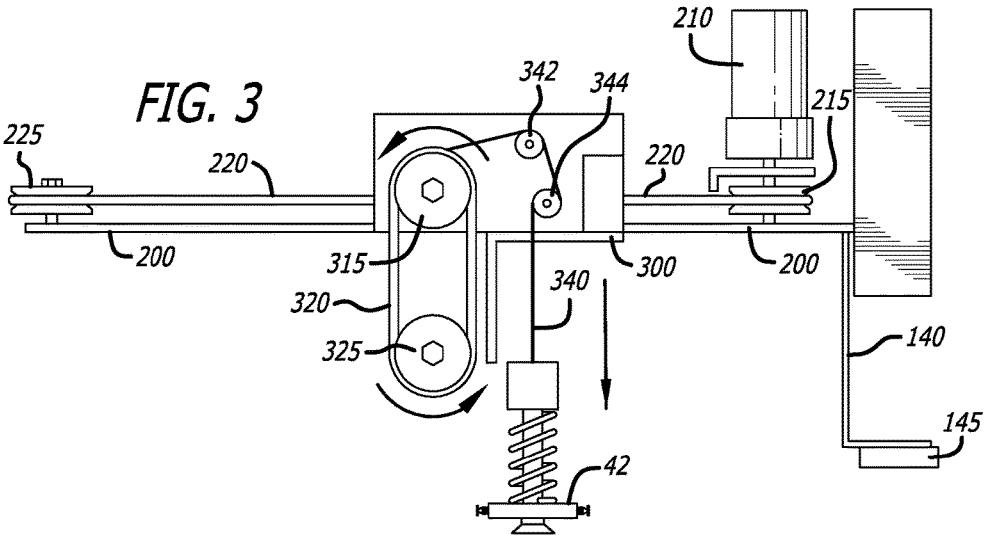
FIGS. 3-5 are side views of the motor assembly for raising and lowering the pick-up device.
Figure 4:
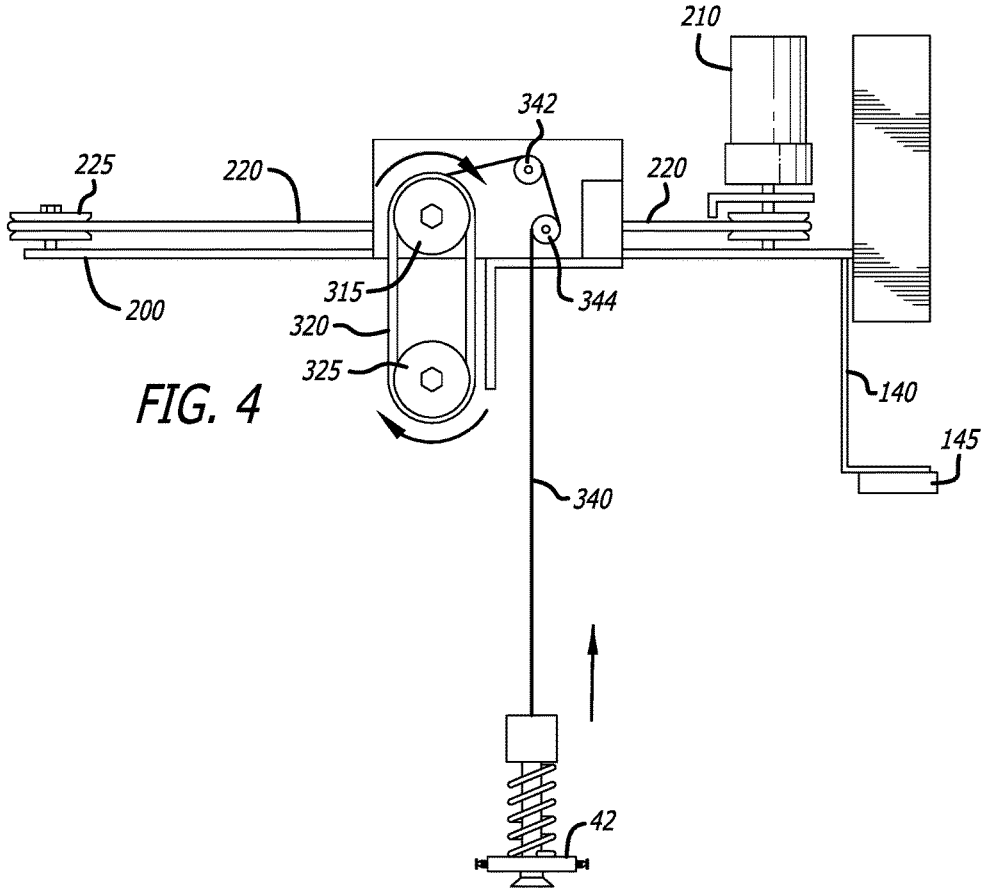
Figure 5:
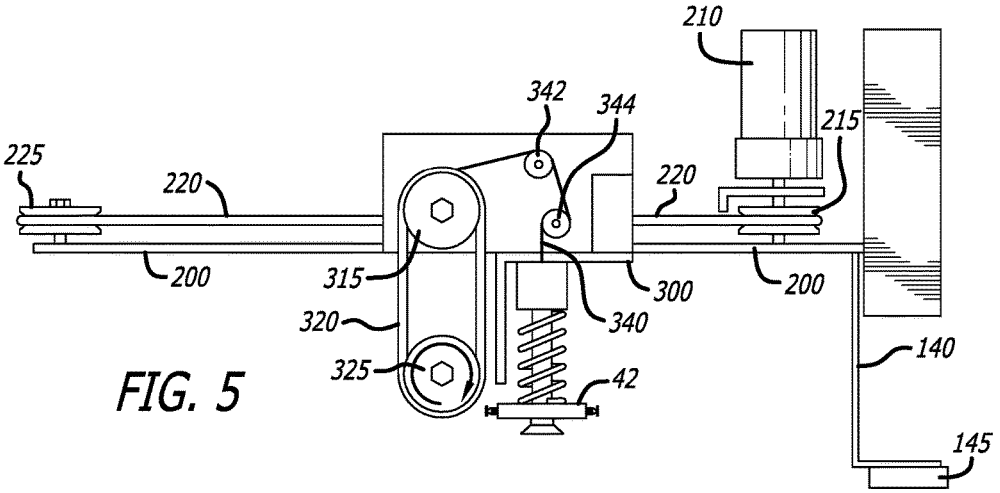
Figure 6:
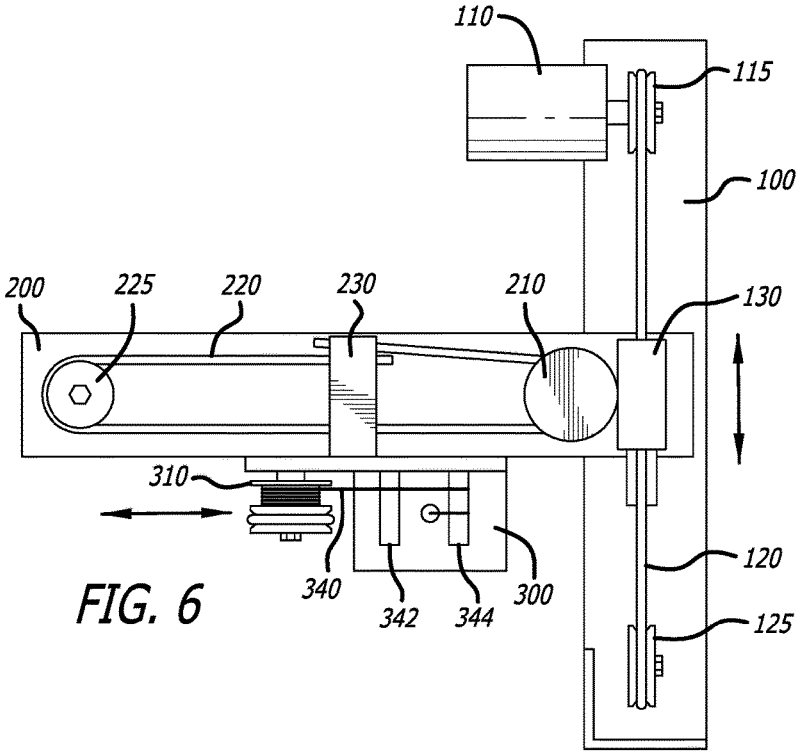
FIG. 6 is a top view of the belt drive system.

The block 230 is connected to a bracket 300 that supports the acquisition device 42. The bracket moves along platform 200 with the block 230 and carries a third electrical motor 310, which has a drive shaft connected to a pulley wheel 315. The bracket 300 has a second pulley 325 mounted below the first pulley wheel 315, and is connected by a belt 320. Pulley wheel 325 has a groove for receiving the belt 320. A cable 340 is connected to pulley 315, and the opposite end of the cable 340 is connected to the acquisition device 42. Rotation of the motor 310's drive shaft unspools the cable 340 over two spindles 342, 344 to lower the acquisition device 42 to the bottom of the playing field (see FIGS. 3-5). There is one switch needed to signal the limit that the motor can lower the pick-up device. The reason for this is that there is nothing to cause the belt to slip and the motor would continue to re-wrap the pick-up device. When this switch closes the up-down (A) motor reverses and the pick-up device rises until the belt slips. Rotation of the motor in the opposition direction winds the cable around the pulley 315 and draws the acquisition device upward. Thus, depending upon the direction of rotation of the motor's drive shaft, the acquisition device 42 is lowered or raised to select a prize as part of the game's challenge.

The use of the pulley and conforming slipping belt allows the belt to slip when the motor drives each respective block to the end of the track, eliminating the need for a clutch or other switch. This dramatically lowers the cost and the space requirements, allowing the game to be made smaller. This, in turn, allows the game to service more markets by reducing the footprint that the game requires, and also reduces the overall cost of the game while increasing the reliability since there are fewer parts to wear out or malfunction. If the belt is connected to its respective block in manner that allows the belt to be adjusted, such as an adjustable clamp, buckle, or tie, then any slack in the belt can be eliminated by simply pulling on the belt to shorted the length between the motor and the block connection. This also allows quick and efficient maintenance of the system with little or no additional hardware or spare parts.

The foregoing description is not intended to be limiting, but rather an example of the present invention. One of ordinary skill in the art would readily recognize that there are many alterations and substitutions to the just-described embodiments, and the present invention is intended to encompass all such substitutions and alterations. Accordingly, the scope of the present invention should be determined by the words of the appended claims using their ordinary meanings, in light of descriptions and depictions herein.

I claim:

1. An arcade game having a housing, player controls, and an acquisition device, comprising:

a first platform mounted in the housing, the first platform supporting a first motor having a drive shaft, first and second pulley wheels, and a first belt connecting the first and second pulley wheels, where the pulley wheels have a groove to receive the first belt and allow slip of the first belt, and a first block connected to the first belt and translatable on a rod from a first end of the first platform to a second end upon actuation of the first motor;

a second platform extending from said first block in a perpendicular direction, the second platform supporting a second motor having a drive shaft, third and fourth pulley wheels, and a second belt connecting the third and fourth pulley wheels, where the pulley wheels have a groove to receive the second belt and allow slip of the second belt, and a second block connected to the second belt and translatable along the second platform upon actuation of the second motor;

a bracket mounted to the second block, the bracket supporting a third motor having a drive shaft and a cable connected thereto, the cable connected to the acquisition device, wherein activation of the third motor moves the acquisition device in the vertical direction;

wherein the player controls actuate the first, second, and third motors to maneuver the acquisition device throughout a playing field of the arcade game.

2. The arcade game of claim 1, wherein the acquisition device is a vacuum pick-up device.

3. The arcade game of claim 1, wherein the first platform includes a stabilizer bar extending below the first platform, and makes contact with the housing wall.

4. The arcade game of claim 1, wherein the player controls includes a joystick.

5. The arcade game of claim 1, wherein the third motor includes a fifth pulley wheel that is connected to a sixth pulley wheel by a third belt, the fifth and sixth pulley wheels having "V"-shaped grooves to receive the third belt.

6. The arcade game of claim 1, wherein the first and second belts are elastic and can be tightened by pulling on an end of the belt connected to its associated block.

* * * * *